US009126713B2

(12) United States Patent
Takanohashi et al.

(10) Patent No.: US 9,126,713 B2
(45) Date of Patent: Sep. 8, 2015

(54) LIQUID-TANK CONNECTOR

(71) Applicant: Surpass Industry Co., Ltd., Gyoda-shi (JP)

(72) Inventors: Toshiyuki Takanohashi, Gyoda (JP); Hiroshi Imai, Gyoda (JP)

(73) Assignee: Surpass Industry Co., Ltd., Gyoda-shi (JP)

( * ) Notice: Subject to any disclaimer, the term of this patent is extended or adjusted under 35 U.S.C. 154(b) by 409 days.

(21) Appl. No.: 13/623,516

(22) Filed: Sep. 20, 2012

(65) Prior Publication Data

US 2013/0291958 A1 Nov. 7, 2013

(30) Foreign Application Priority Data

Sep. 29, 2011 (JP) ..... 2011-214534

(51) Int. Cl.
*F17D 1/00* (2006.01)
*B65D 1/20* (2006.01)
*B67D 7/02* (2010.01)

(52) U.S. Cl.
CPC ..... *B65D 1/20* (2013.01); *B67D 7/0294* (2013.01); *Y10T 137/598* (2015.04)

(58) Field of Classification Search
CPC ..... B67D 1/08; B67D 7/02; B65D 47/06
USPC ..... 137/328, 590, 206, 209; 285/201–201, 285/219–221, 39
See application file for complete search history.

(56) References Cited

U.S. PATENT DOCUMENTS

| | | | | |
|---|---|---|---|---|
| 3,050,218 | A * | 8/1962 | Harvey | 222/498 |
| 4,212,318 | A * | 7/1980 | Warmbold | 137/590 |
| 5,048,309 | A * | 9/1991 | Carlisle, Jr. | 62/503 |
| 6,843,285 | B2 * | 1/2005 | Ozawa | 141/326 |
| 2002/0020449 | A1 * | 2/2002 | Imai | 137/590 |
| 2002/0134440 | A1 * | 9/2002 | Mandzuk | 137/590 |
| 2009/0184119 | A1 * | 7/2009 | Takanohashi | 220/212 |
| 2009/0188919 | A1 * | 7/2009 | Takanohashi | 220/366.1 |

FOREIGN PATENT DOCUMENTS

| | | | |
|---|---|---|---|
| JP | 2006182400 | A | 7/2006 |
| JP | 2011057276 | A | 3/2011 |
| JP | 2011057277 | A | 3/2011 |
| JP | 4713676 | B1 | 6/2011 |

* cited by examiner

*Primary Examiner* — Craig Schneider
*Assistant Examiner* — Angelisa L Hicks
(74) *Attorney, Agent, or Firm* — Winstead PC

(57) ABSTRACT

Provided are a joining portion in which a male threaded portion threaded to a container-side female threaded portion is formed; a connector main unit disposed at an inner side of the joining portion, sharing a center axis therewith, and is connected so as to be rotatable relative thereto; and a siphon tube attached to the connector main unit so as to extend toward the bottom portion of the container and has a tip curved in a substantially horizontal direction, wherein the joining portion is screwed in independently of the connector main unit when attaching the connector by using a securing jig that, by being inserted from above the connector main unit, causes depressed/protruding portions to be engaged, thus preventing relative rotation to each other, and by using a tightening jig that tightens the male threaded portion by being engaged at the upper surface of the joining portion.

6 Claims, 7 Drawing Sheets

LIQUID-TANK CONNECTOR

CROSS-REFERENCE TO RELATED APPLICATIONS

This application is based on Japanese Patent Application No. 2011-214534, the contents of which are incorporated herein by reference.

TECHNICAL FIELD

The present invention relates to a liquid-tank connector for supplying liquid in a liquid tank to the exterior.

BACKGROUND ART

Liquid, such as high-purity semiconductor chemicals, general chemicals, and so forth, is generally filled in a liquid tank, such as a polyethylene tank or the like, in a production factory, and is shipped in a state in which a lid is attached to a vent plug portion formed in the liquid tank for filling/drawing out liquid. A siphon tube system is a known method of drawing out liquid contained in such a liquid tank, in which the liquid is supplied outside a container by gas pressure generated by introducing gas, such as air or the like, into the container.

With this system, a plug provided with a siphon tube, which serves as a liquid flow channel, and a gas supplying channel is attached to the vent plug portion after removing the lid attached to the vent plug portion of the liquid tank. Then, a liquid flow channel for drawing out the liquid and a gas flow channel for introducing gas are formed by connecting the plug to a socket to which a tube for drawing out the liquid outside the liquid tank and a tube for introducing gas can be individually connected.

Because such a liquid-tank connector is threaded to a container (vent plug portion), the connector needs to be rotated when attaching it to the container. Because of this, with a structure in which a tip of a siphon tube is curved so as to reduce the amount of liquid remaining in a container, it is difficult to place an opening provided at the tip thereof in the deepest region due to the rotation of the connector, and, as a measure for coping with this, a connector having a structure that connects a joining portion and a main unit in a manner allowing them to be relatively rotated about a center axis has been proposed (for example, see Japanese Unexamined Patent Application, Publication No. 2006-182400).

SUMMARY OF INVENTION

Technical Problem

For the liquid tank described above, a blow-molded product made of plastic (polyethylene or the like) is generally used. With such a blow-molded liquid tank, because, in principle, only the external shape of the product can be controlled during molding, a parting line remains at the inner bottom portion of the container. This parting line is a protruding portion that is formed at a portion where the left and right metal molds are joined, protruding on a center line of the inner bottom surface of the container, and that, in general, linearly extends toward both sides from a substantially circular center portion.

Because of this, when the siphon tube is inserted into and attached to a blow-molded liquid tank, the bottom end of the siphon tube hits an upper surface of the protruding portion of the parting line, the result of which is that liquid below the protruding portion cannot be taken in, thus causing the liquid to remain in the tank. For reasons associated with the blow molding, a center position of the vent plug portion in the container side, to which the connector is threaded and attached, is inevitably aligned with the dividing position of the metal molds.

On the other hand, with the connector disclosed in Japanese Unexamined Patent Application, Publication No. 2006-182400, because the joining portion to be screwed into a container-side threaded portion and the main unit to which the siphon tube is secured are connected so as to be relatively rotatable about the center axis, the connector can be installed in the container by rotating only the joining portion. Because of this, the siphon tube, having a curved tip, is isolated from the screwing of the joining portion and is not affected by the screwing operation; therefore, the siphon tube can be easily installed at a position away from the parting line.

However, because the connector disclosed in Japanese Unexamined Patent Application, Publication No. 2006-182400 has a structure in which the joining portion is screwed into the top-end surface of the main unit and secured thereto, the bottom-end surface of the joining portion comes into contact with the top-end surface of the main unit when the joining portion approaches a position where tightening is completed. Because of this, when the joining portion receives a large tightening force, the main unit is rotated together with the joining portion due to the frictional force. Therefore, the siphon tube is also rotated together with the joining portion, integrally with the main unit, and, because this causes the position of the tip of siphon tube to be shifted to a position on the parting line, if such a positional shift occurs, this causes liquid that cannot be taken in to remain in the container.

Given this background, there is a need, from the viewpoint of eliminating liquid that remains in a container, for making it possible to easily and reliably install a liquid-tank connector that is used by being attached to a blow-molded liquid tank so that a curved tip of a siphon tube is positioned away from the parting line.

The present invention has been conceived in order to solve the above-described problems, and an object thereof is to provide a liquid-tank connector that can be easily and reliably installed so that a curved tip of a siphon tube is positioned away from the parting line.

Solution to Problem

The present invention employs the following solutions in order to solve the above-described problems.

A liquid-tank connector according to the present invention is a liquid-tank connector a that is installed at a vent plug portion of a container storing liquid and that draws out the liquid from the container, including a joining portion in which an outer threaded portion that is threaded to a container-side inner threaded portion formed in the vent plug portion is formed; a main unit that is disposed at an inner side of the joining portion, sharing a center axis therewith, and that is connected so as to be rotatable relative thereto; and a liquid draw-out tube that is attached to the main unit so as to extend toward the bottom portion of the container and that has a tip curved in a substantially horizontal direction, wherein the joining portion is screwed in independently of the main unit when attaching the connector by using a securing jig that, by being attached from above to the main unit, causes depressed/protruding portions provided between contact surfaces to be engaged, thus preventing relative rotation to each other, and by using a tightening jig that tightens the outer threaded portion by being engaged at the upper surface of the joining portion.

Such a liquid-tank connector can prevent the curving direction of the tip of the liquid draw-out tube from being changed due to drag rotation because the joining portion is screwed in independently of the main unit when attaching the connector by using the securing jig that, by being attached from above to the main unit, causes the depressed portion and the protruding portion provided between the contact surfaces to be engaged, thus preventing relative rotation to each other, and by using the tightening jig that tightens the outer threaded portion by being engaged at the upper surface of the joining portion. In this case, the depressed/protruding portions provided between the contact surfaces are engaged, for example, in a configuration in which the depressed/protruding portions are provided assuming that the upper surface of the main unit and the lower surface of the securing jig serve as the contact surfaces or in a configuration in which the depressed/protruding portions are provided assuming that the inner circumferential surface of the depressed portion of the main unit and the outer circumferential surface (side surface) of the securing jig serve as the contact surfaces.

Suitable liquid draw-out tubes in this case include a siphon tube, a dip tube, and so forth, and in the case in which the liquid draw-out tube is a siphon tube in particular, it is desirable that the securing jig be configured to be inserted from above into the circular hollow portion formed at the upper surface of the main unit so as to cause the depressed/protruding portions between the contact surfaces to be engaged; in other words, it is desirable that the depressed/protruding portions be provided assuming that the inner circumferential surface of the circular hollow portion of the main unit and the outer circumferential surface of the securing jig serve as the contact surfaces.

With such a configuration, because the joining portion can be tightened by the tightening jig while holding the main unit by using the securing jig so that the main unit and the liquid draw-out tube are not rotated when attaching the connector, it is possible to maintain the curving direction of the tip of the liquid draw-out tube, such as a siphon tube or a dip tube, inserted into the container, which is oriented in the desired direction so as not to overlap with the upper surface of protruding portion of the parting line.

In the invention described above, it is preferable that the depressed/protruding portions between the contact surfaces be a depressed portion or protruding portion provided at an outer circumferential surface of the securing jig and a protruding portion or depressed portion formed at an inner circumferential surface of the circular hollow portion; accordingly, the securing jig can be easily inserted from above the main unit into the depressed space of the circular hollow portion to be attached thereto, which makes it possible to reliably prevent the main unit from being rotated by the securing jig.

In this case, if the protruding portions or depressed portions provided at the circular hollow portion have different combinations in terms of the numbers thereof arranged in the circumferential direction depending on the type of the connector, the protruding portions or depressed portions can be utilized to prevent a wrong combination with the socket which is connected to the connector by being inserted into the circular hollow portion thereof when drawing out the liquid. Specifically, by providing the same type of the connector and socket with the depressed/protruding portions having the same circumferential arrangement, it is possible to prevent a socket insertion in a combination involving different types.

In the invention described above, it is preferable that the protruding portion or depressed portion provided at the outer circumferential surface of the securing jig be provided so as to be compatible with multiple types of connector with respect to the protruding portion or depressed portion at the circular hollow portion; accordingly, a shared use of the securing jig is possible.

In the invention described above, it is preferable that the main unit be provided with a curving-direction indicating portion for the liquid draw-out tube at the upper surface of the outer circumference; accordingly, the curving direction of the tip of the liquid draw-out tube in the container can be easily ascertained.

If the securing jig is provided with an insertion-position indicating portion whose position in the circumferential direction is aligned with the curving-direction indicating portion at a position where the depressed/protruding portions are engaged, the securing jig can be easily positioned and inserted into the circular hollow portion.

It is preferable that the circular hollow portion be a key ring portion that is attached at the top portion of the main unit, forming a single piece therewith; accordingly, the main unit and the key ring can be formed into a single piece after easily molding them as separate parts. It is desirable that the main unit and the key ring be formed into a single piece by means of, for example, ultrasonic welding or the like.

Advantageous Effects of Invention

With the liquid-tank connector of the present invention described above, a curved liquid draw-out tube, which is oriented in a desired direction in the container, can be prevented from being rotated together with a main unit due to tightening of a joining portion when attaching the connector. As a result, the position (direction) of the tip of the curved liquid draw-out tube does not change due to tightening of the joining portion for attaching the connector; therefore, even in the case in which the connector is used by being attached to a blow-molded liquid tank, a considerable advantage is afforded in that the amount of liquid remaining in the container is reduced because the liquid draw-out tube can be easily and reliably installed at a position where the curved tip that takes in liquid is away from the parting line.

DESCRIPTION OF EMBODIMENT

An embodiment of a liquid-tank connector according to the present invention will be described below with reference to the drawings.

Figure 4:
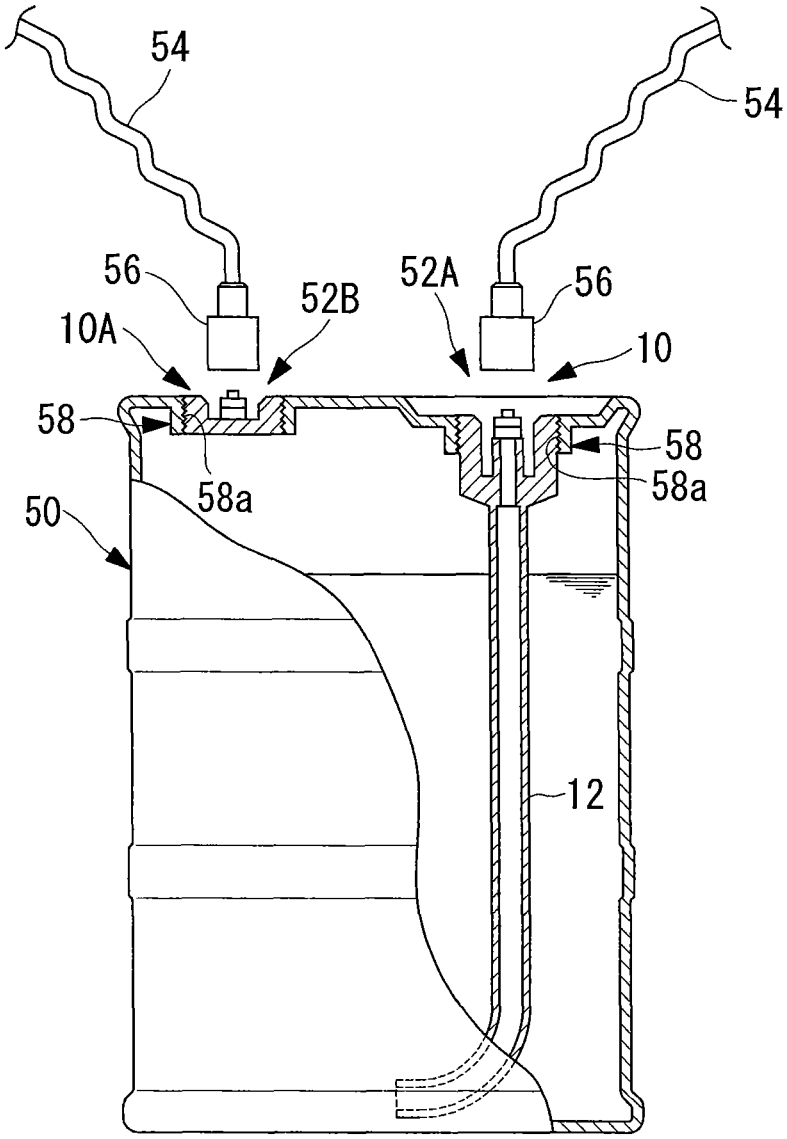
FIG. 4 is an explanatory diagram showing, in outline, an example configuration of a container in which the liquid-tank connector according to the present invention is employed.

FIG. 4 is a diagram for explaining a state in which a liquid-tank connector (hereinafter, referred to as "connector") 10 of the present invention is connected to a container 50 that stores liquid such as high-purity semiconductor chemicals, or the like. This connector 10 is provided with a siphon tube (liquid draw-out tube) 12 that has sufficient length to reach a bottom surface of the container 50 and also has a tip curved in a substantially horizontal direction. The liquid draw-out tube in this case is not limited to the siphon tube 12, and, for example, as in a connector 10A shown in FIG. 7, a dip tube 12A provided on a connector main unit 30A may be employed.

Two openings (vent plug portions) 52A and 52B are formed at an upper surface of the container 50, where a liquid draw-out connector 10 is attached to one of them, namely, the opening 52A, and a gas-circulating connector 10A is attached to the other, namely, the opening 52B.

Sockets 56 having hoses 54 are attached to the connectors 10 and 10A in an attachable/detachable manner. The liquid in the container 50 is drawn up from the socket 56 and the hose 54 attached to the connector 10, and gas is supplied into the container 50 from the socket 56 and the hose 54 attached to the connector 10A. Reference sign 58 in the figure is an inner lid of the container 50, and a female threaded portion (inner threaded portion) 58*a* for attaching the connector is formed in this inner lid 58.

Figure 5:
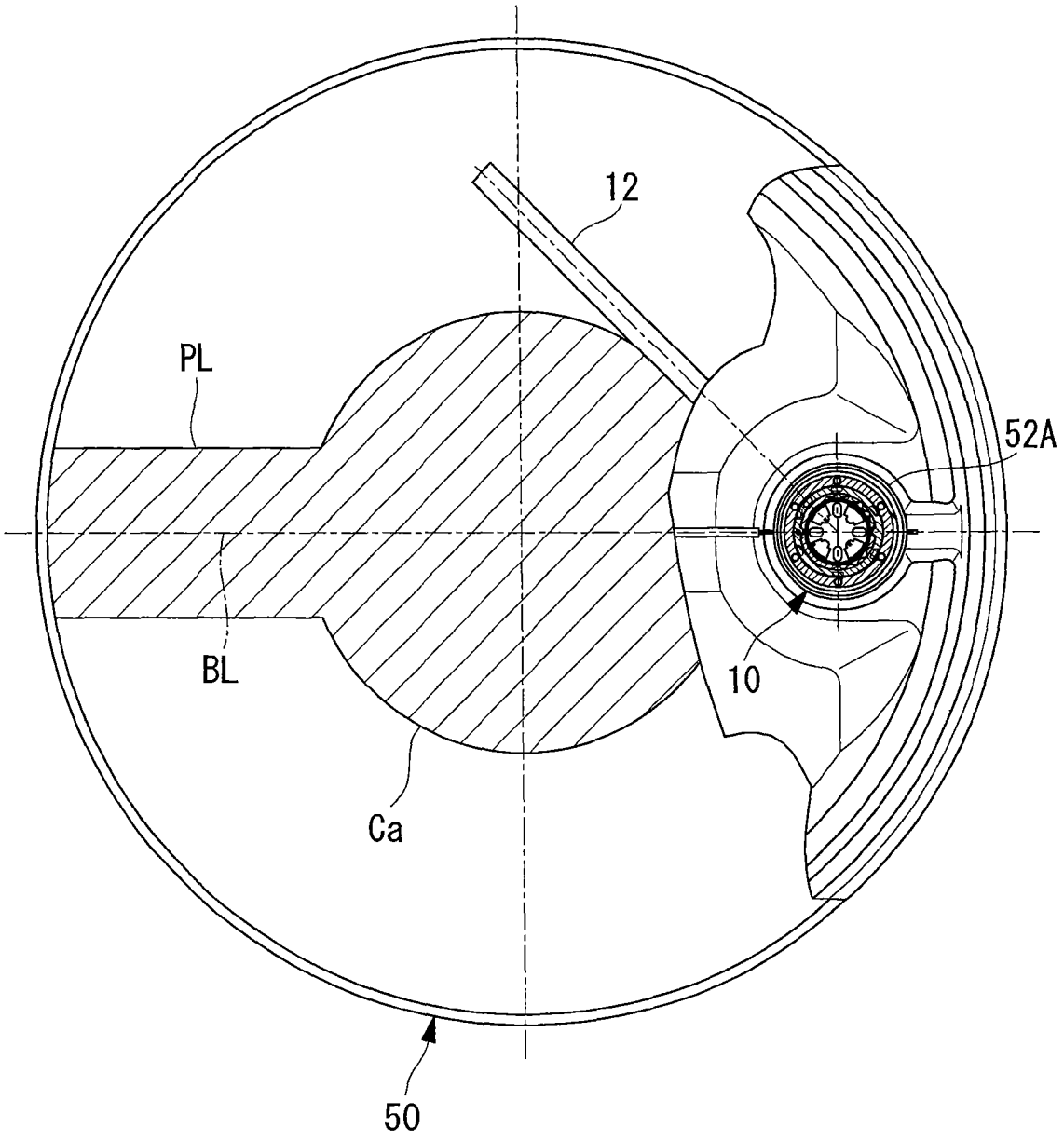
FIG. 5 is a lateral sectional view of the interior of the container showing an example shape of an inner bottom surface of the container.

The container 50 is a blow-molded product manufactured, for example, by blow molding a plastic such as polyethylene or the like. Accordingly, because a center position of the opening 52A described above is aligned with the dividing position (dividing line BL) of the molding metal molds in plan view, for example, as in a lateral sectional view of the interior of the container shown in FIG. 5, the center position of the opening 52A is also aligned with a parting line PL formed at the inner bottom portion of the container 50. This parting line PL is a protruding portion that is formed at a portion where the left and right metal molds are joined, protruding on the dividing line BL at the inner bottom surface of the container and, in general, linearly extends to both the left and right along the dividing line BL from a substantially circular center portion Ca. The dividing line BL described above is also aligned with the center line of the container 50.

Figure 1:
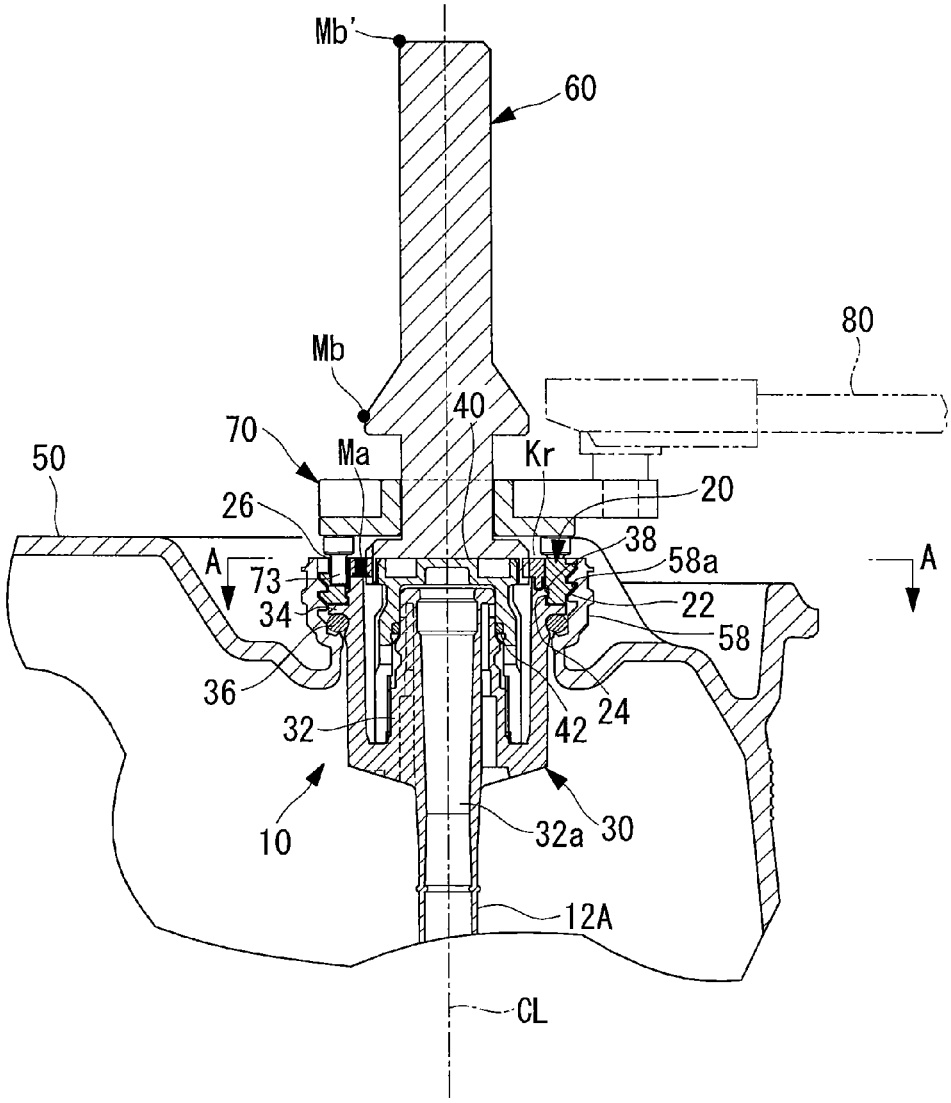
FIG. 1 is a longitudinal sectional view of a relevant portion showing an embodiment of a liquid-tank connector according to the present invention, and, for the case in which a liquid draw-out tube is a siphon tube, a state in which the liquid-tank connector is attached to a vent plug portion of a container by using a securing jig and a tightening jig is shown.
Figure 2:
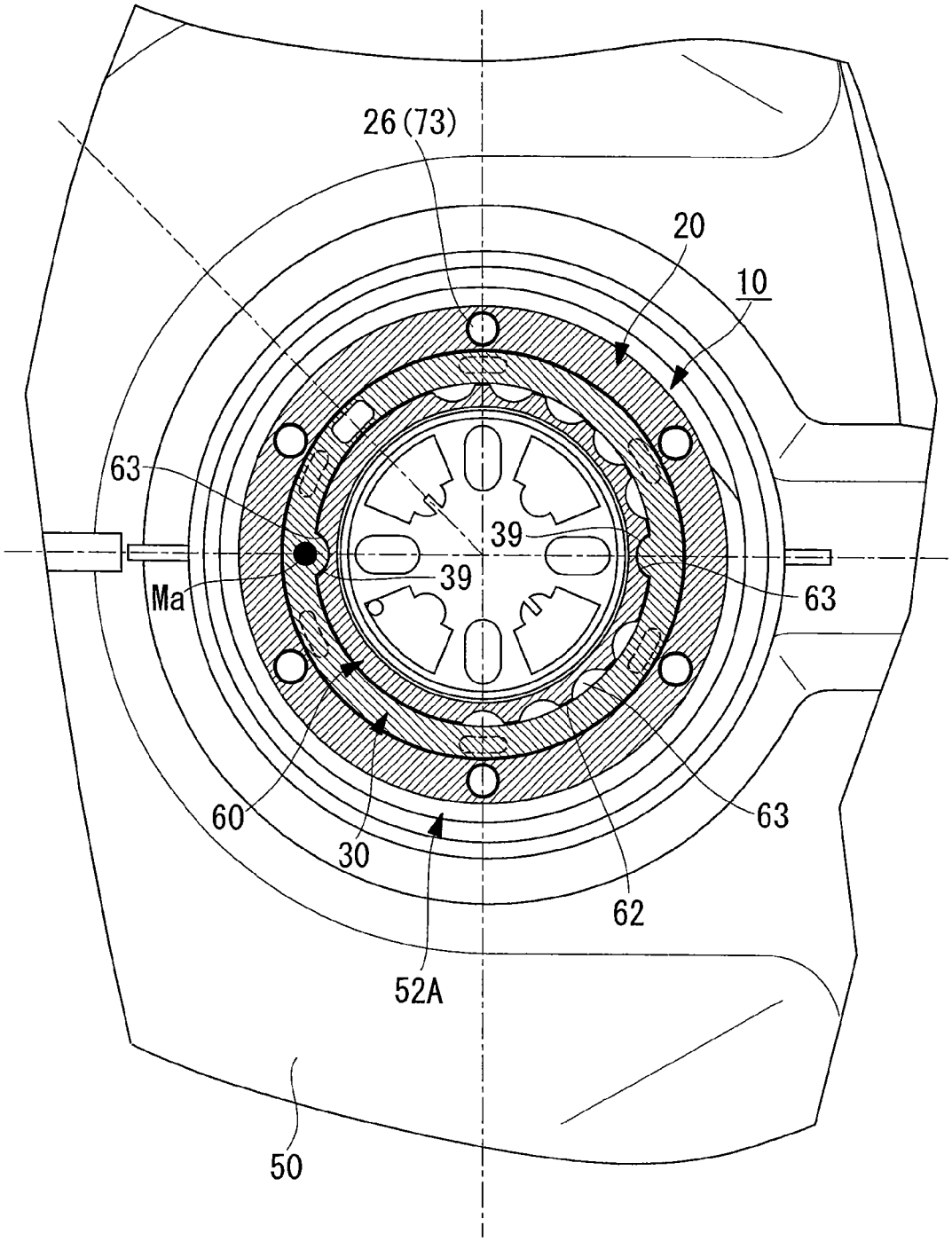
FIG. 2 is a sectional view taken along A-A in FIG. 1.
Figure 3:
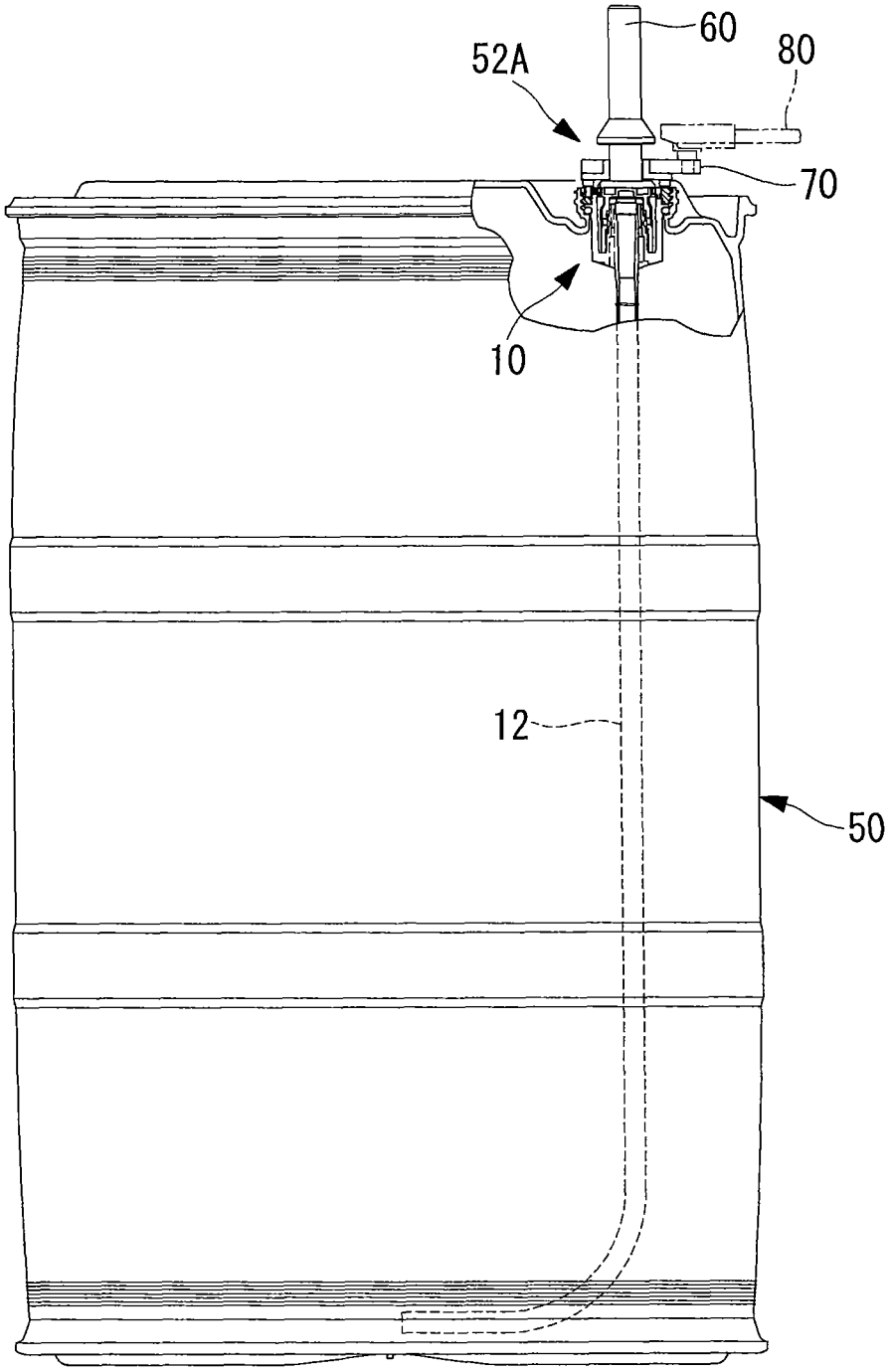
FIG. 3 is a partial-sectional overall diagram showing a state in which the liquid-tank connector shown in FIG. 1 is attached to a container.

Next, an example configuration of the above-described connector 10 will be described with reference to FIGS. 1 to 3. FIGS. 1 to 3 show a state in which the connector 10 is attached to the opening 52A of the container 50 by using a securing jig 60 and a tightening jig 70, described later.

The connector 10 is installed at the opening 52A, which is a vent plug portion of the container 50 storing liquid, and, by connecting the socket 56 and the hose 54 to this connector 10, the liquid in the container 50 is drawn out by utilizing the pressure of the gas supplied from the opening 52B.

The illustrated connector 10 is provided with a joining portion 20 in which a male threaded portion (outer threaded portion) 22 is formed, which is threaded to the female threaded portion (inner threaded portion) 58*a* formed at the opening 52A of the container 50; a connector main unit (main unit) 30 that is disposed on the inner side of this joining portion 20, sharing a center axis CL therewith, and that is connected so as to be rotatable relative thereto; and the siphon tube 12 having a tip curved in a substantially horizontal direction that is attached to this connector main unit 30 and that extends toward the bottom portion of the container 50.

Specifically, the configuration of the connector 10 of this embodiment, in outline, includes the connector main unit 30 which is the main portion of the connector 10; the joining portion 20 that is joined with the container 50 by being threaded to the female threaded portion 58*a* formed at the inner lid 58 of the container 50; and the siphon tube 12 securely connected to a plug portion 32 of the connector main unit 30. The plug portion 32, which is a portion of the connector main unit 30, is a portion connecting with the socket 56 described above and is a portion through which the liquid in the container 50 flows by passing through a circulation hole 32*a*.

The joining portion 20 is a substantially ring-shaped member in which the male threaded portion 22 that is threaded to the female threaded portion 58*a* of the inner lid 58 is formed at an outer circumferential surface thereof. At the bottom end of an inner circumferential surface of the joining portion 20, a joining-portion projection 24 is formed, which protrudes radially inward around the circumferential direction and engages with a main-unit projection 38 of the connector main unit 30, described later.

On other hand, a plurality of jig-attaching holes 26 to which the tightening jig 70 is engaged are provided at the top-end surface of the joining portion 20, being arranged at equal pitch in the circumferential direction (six at 60° pitch in the illustrated example configuration).

The connector main unit 30 is assumed to have a substantially cylindrical shape with a closed bottom, in which a circular hollow portion is formed at the upper surface thereof, and the plug portion 32 is integrally formed at the inner bottom surface thereof so as to protrude from the bottom surface. The joining portion 20 is concentrically disposed at the opening end at the top of the connector main unit 30 so as to be rotatable about the center axis CL of the connector main unit 30 on the outer circumferential side thereof.

In this embodiment, the circular hollow portion of the connector main unit 30 is formed by a key-ring portion Kr attached at the top of the main unit to form a single piece. Specifically, it is preferable that the connector main unit 30 be structured such that the key-ring portion Kr, molded as a separate part, is secured thereto by means of ultrasonic welding or the like to form a single piece, and thus, the top-end surface of the key-ring portion Kr serves as a peripheral upper surface of the circular hollow portion. This is because the connector main unit 30 can be more easily manufactured by forming a single piece with the key-ring portion Kr after molding it as a separate piece, as compared with molding the connector main unit 30 as a single piece.

A flange portion 34 that protrudes radially outward is formed at the outer circumferential surface of the connector main unit 30, and an O-ring 36 is disposed between a surface of the flange portion 34 close to the siphon tube 12 (lower surface in the figure) and the inner lid 58 as a seal member compressed therebetween. The main-unit projection 38 that protrudes radially outward in the circumferential direction and that engages with the joining portion 20 is formed around the outer circumferential surface of the connector main unit 30 at the opening end thereof.

A cap 40 formed in a substantially cylindrical shape with a closed bottom is threaded and attached to the top-end surface and outer circumference of the plug portion 32, and an O-ring 42 is provided as a seal member. The cap 40 is removed from the plug portion 32 when attaching the socket 56 to the connector 10, and the cap 40 is otherwise kept attached to the plug portion 32, preventing a fluid from flowing out.

When removing the cap 40, for example, a jig for rotating the cap is used.

After the siphon tube 12 is inserted into the container 50 and installed in the opening 52A, the connector main unit 30 configured in this way is secured by the joining portion 20 tightened from above so that the male threaded portion 22 is threaded to the female threaded portion 58*a* of the inner lid 58. At this time, the tip of the curved portion of the siphon tube 12 is oriented in a desired direction away from the parting line PL.

Specifically, because the above-described connector 10 is formed such that the inner diameter of the joining-portion projection 24 is larger than the outer diameter of the main-unit projection 38, the joining-portion projection 24 is engaged with the main-unit projection 38; the connector main unit 30 and the joining portion 20 are engaged in a manner allowing rotation about the center axis CL; and the flange portion 34 is pressed downward from above and secured by the lower surface of the joining portion 20.

In order to make it possible to easily ascertain the curving direction of the tip of the siphon tube 12 in the container 50, a curving-direction indicating portion Ma should be provided at an appropriate position in the connector main unit 30, for example, an easily visible position, as shown in FIGS. 1 and 2. The curving-direction indicating portion Ma is formed as a depressed/protruding portion, a colored portion, an arrow mark, and so forth, and, because the siphon tube 12 is secured and connected to the plug portion 32, the curving-direction indicating portion Ma should be provided, for example, at the peripheral upper surface of the circular hollow portion so as to be aligned with the curving direction.

Figure 6A:
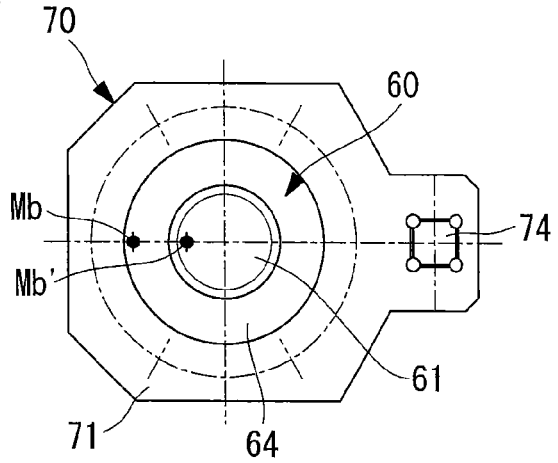
FIG. 6A is a plan view showing an example configuration of a jig used when attaching the liquid-tank connector to the container.
Figure 6B:
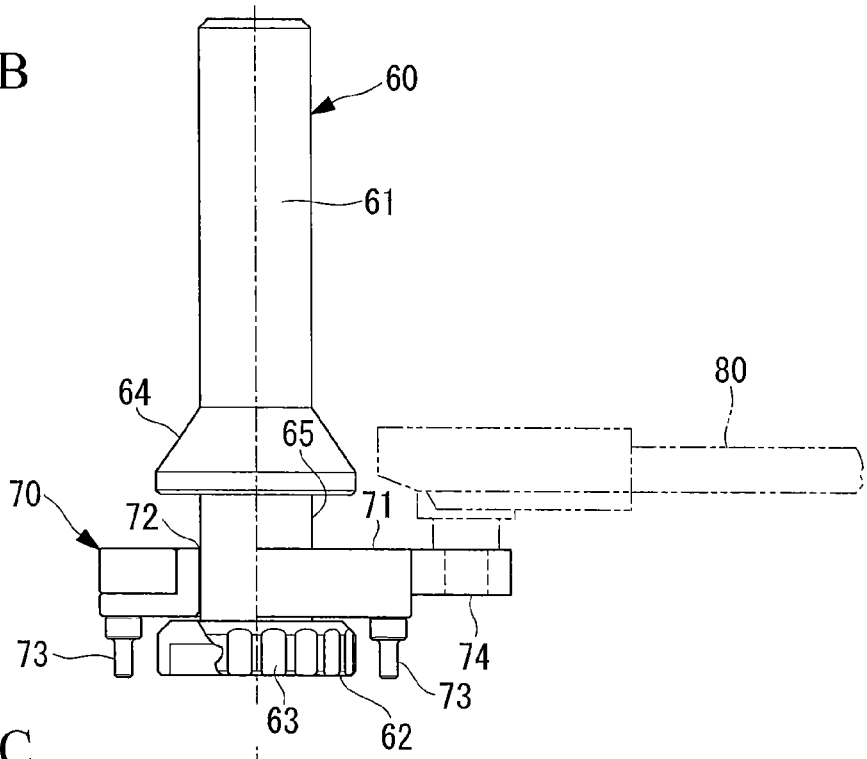
FIG. 6B is a front view showing an example configuration of the jig used when attaching the liquid-tank connector to the container.
Figure 6C:
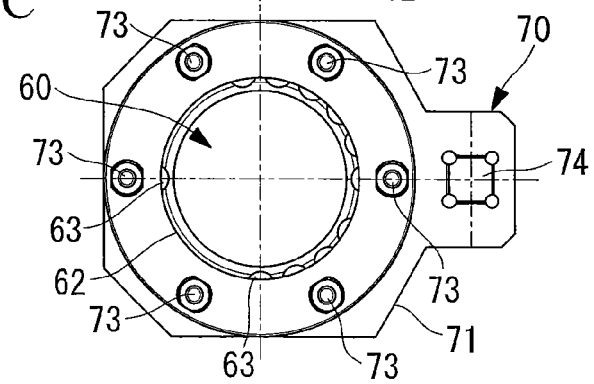
FIG. 6C is bottom view showing an example configuration of the jig used when attaching the liquid-tank connector to the container.

When tightening the joining portion 20 described above, the securing jig 60 and the tightening jig 70, for example, ones like those shown in FIGS. 6A to 6C, are used, and the joining portion 20 is screwed in independently of the connector main unit 30 when attaching the connector. Specifically, when attaching the connector, the connector main unit 30 is secured by the securing jig 60, which is held by human strength or the like, so as not to be rotated, and only the joining portion 20 is rotated and tightened by the tightening jig 70.

The securing jig 60 is provided with a column-shaped hollow locking portion 62 at the bottom end of a column-shaped handle 61, and is used by inserting the locking portion 62 from above into the circular hollow portion formed so as to open at the upper surface of the connector main unit 30. Specifically, the securing jig 60 is used by being attached from above to the connector main unit 30.

Depressed portions 63 of depressed/protruding portions are formed at the outer circumferential surface of the locking portion 62, and, by engaging these depressed portions 63 with protruding portions 39 of the depressed/protruding portions formed at the inner circumferential surface of the circular hollow portion of the connector main unit 30, the depressed/protruding portions between the contact surfaces are engaged, thus making it possible to prevent relative rotation to each other. With the illustrated configuration example, the securing jig 60 has a two-part structure that can be divided into the handle 61 and the locking portion 62 and is provided with a connecting portion 65 having a circular sectional shape between the locking portion 62 and an umbrella portion 64 provided at one end of the handle 61.

The tightening jig 70 tightens the outer threaded portion 22 by being engaged at the upper surface of the joining portion 20 and by being rotated by using a tool 80 such as a torque wrench or the like. A jig main unit 71 of tightening jig 70 is provided with a through-hole 72 where the securing jig 60 passes through, a plurality of projected portions 73 that engage with the upper surface of the joining portion 20, and a tool hole 74 where the tool 80 engages.

The through-hole 72 has a large enough hole diameter so that the connecting portion 65 of the securing jig 60 passes therethrough without interfering with the tightening jig 70.

The projected portions 73 are pin-shaped members that, by being inserted into the jig-attaching holes 26 provided at the top-end surface of the joining portion 20, transmit rotational force by engaging the tightening jig 70 and the joining portion 20. The plurality of projected portions 73 protrude from the lower surface of the jig main unit 71, provided at equal pitch in the circumferential direction (six at 60° pitch in the illustrated example configuration).

The tool hole 74 is a part into which an engaging portion of the tool 80 is inserted, transmitting torque to the jig main unit 71, and is provided at a position in the jig main unit 71 that protrudes toward the outer circumference thereof.

With the above-described embodiment, a pair of protruding portions 39 are provided at the inner circumferential surface of the circular hollow portion of the connector main unit 30 so as to be engaged with the depressed portions 63 that are provided, in equal or greater number, at the outer circumferential surface of the locking portion of the securing jig 60, which makes it possible to easily insert the securing jig 60 from above into the depressed space of the circular hollow portion of the connector main unit 30 to attach it thereto. However, such depressed/protruding portions may be formed with the depression and protrusion thereof reversed so long as the connector main unit 30 can be reliably prevented from being rotated by the securing jig 60. Specifically, a pair of depressed portions may be provided at the inner circumferential surface of the circular hollow portion of the connector main unit 30 so as to be engaged with protruding portions provided at the outer circumferential surface of the locking portion of the securing jig 60.

In this case, the depressed/protruding portions 39 and 63 are not limited to the illustrated semi-circular shape, and they may have, for example, a triangular shape or the like, so long as their mutual engagement can prevent relative rotation to each other.

The thus-configured connector 10 can prevent the curving direction of the tip of the siphon tube 12 from being changed due to drag rotation, because the joining portion 20 is screwed in independently of the connector main unit when attaching the connector by using the securing jig 60 that, by being inserted from above into the circular hollow portion formed at the upper surface of the connector main unit 30, causes the depressed/protruding portions 39 and 63 to be engaged, thus preventing relative rotation to each other, and by using the tightening jig 70 that tightens the male threaded portion 22 by being engaged at the upper surface of the joining portion 20. In other words, when attaching the connector, the joining portion 20 can be tightened by the tightening jig 70 while holding the connector main unit 30 by using the securing jig 60 so that the connector main unit 30 and the siphon tube 12 are not rotated, and, consequently, it is possible to maintain the curving direction of the tip of the siphon tube 12 inserted into the container 50, which is oriented in the desired direction in advance so as not to overlap with the upper surface of the protruding portion of the parting line PL.

If the protruding portions 39 or depressed portions provided at the circular hollow portion of the connector main unit 30 described above have different combinations in terms of the numbers thereof arranged in the circumferential direction depending on the types of the connector 10, the protruding portions 39 or depressed portions can be utilized to prevent a wrong combination with the socket 56 which is connected to the connector main unit 30 by being inserted into the circular hollow portion thereof when drawing out the liquid. Specifically, by providing the same type of the connector 10 and the socket 56 with the depressed/protruding portions having the same circumferential arrangement and numbers, insertion is made impossible with a wrong combination because the depressed/protruding portions create portions where interference occurs therebetween; therefore, it is possible to prevent a wrong combination in which the socket 56 is inserted in a combination involving different types.

It is desirable that the depressed portions 63 or protruding portions provided at the outer circumferential surface of the securing jig 60 be provided so as to be compatible with a plurality of different types of the connector main unit 30 with respect to the protruding portions 39 or depressed portions. Specifically, because the illustrated securing jig 60 is provided with a total of 11 depressed portions 63 at different positions in the circumferential direction, the single securing jig 60 can be compatible with multiple types of connector main unit 30 in addition to, for example, the case in which a pair of protruding portions 39 are positioned at 180°, thus making shared use of the securing jig 60 possible.

It is desirable that the securing jig 60 described above be provided with an insertion-position indicating portion Mb at an appropriate easily visible position so that the circumferential position thereof is aligned with the curving-direction indicating portion Ma at a position where the depressed/protruding portions 39 and 63 are engaged. Although the insertion-position indicating portion Mb in the illustrated example configuration is formed at the upper surface of the umbrella portion 64 which forms the securing jig 60, it may be provided, for example, at the top-end surface of the handle 61 as an insertion-position indicating portion Mb'.

By providing such insertion-position indicating portions Mb and Mb', the depressed/protruding portions 39 and 63 can be easily positioned by visually checking from above when using the securing jig 60 by inserting it into the circular hollow portion.

Figure 7:
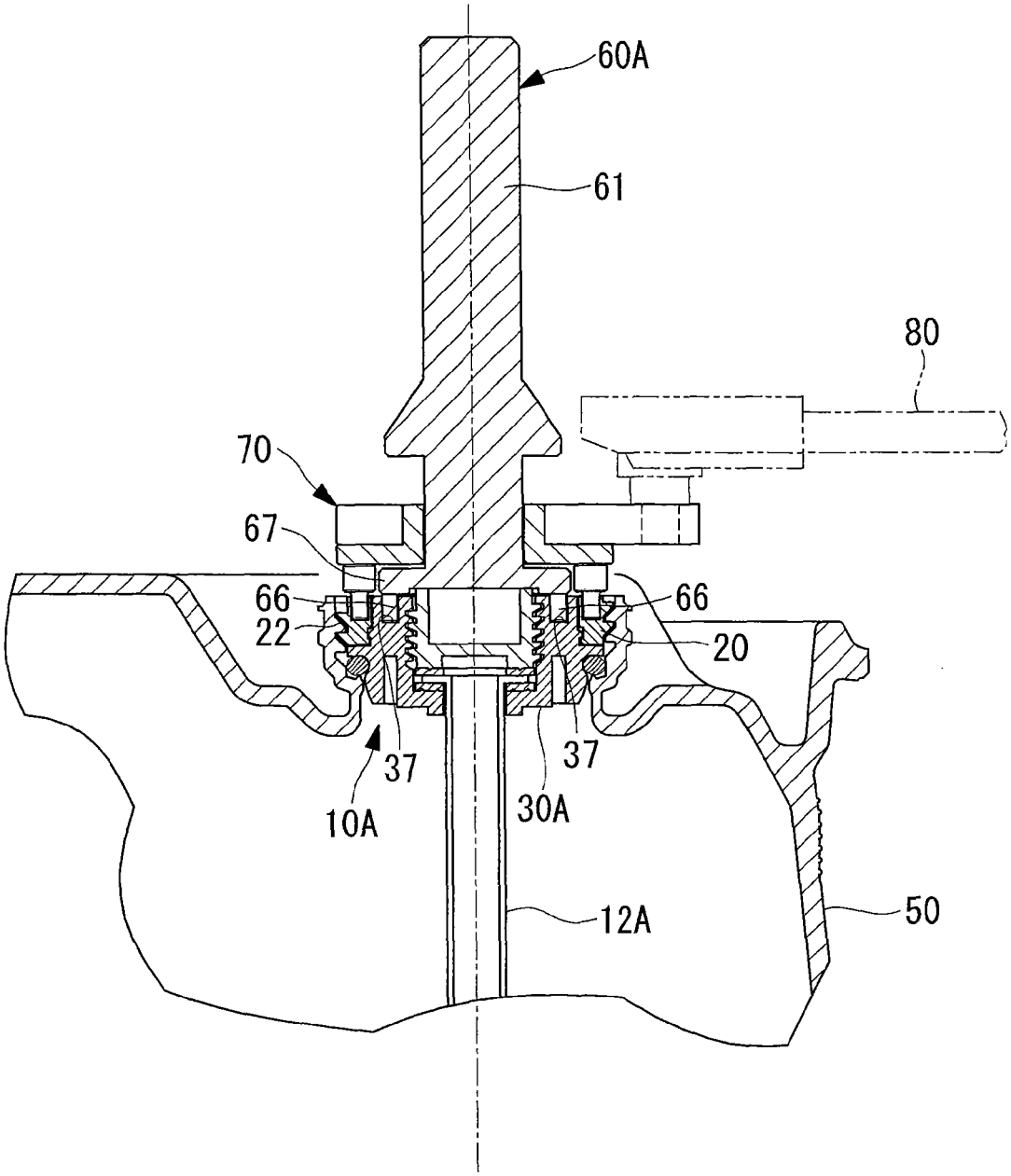
FIG. 7 is a longitudinal sectional view of a modification of the liquid-tank connector shown in FIG. 1, showing an example configuration of a relevant portion for the case in which a liquid draw-out tube is a dip tube.

A securing jig 60A shown in FIG. 7 is employed for a connector main unit 30A provided with a dip tube 12A as in a connector 10A. This securing jig 60A is used by being attached from above to the connector main unit 30A.

A ring-shaped upper surface formed at the top end of the connector main unit 30A is provided with pin-inserting holes (depressed portions) 37 into which pins (protruding portions) 66 of the securing jig 60A are inserted. The pins 66 are portions that protrude downward from the lower surface of a disk-shaped portion 67 integrally provided with the handle 61 of the securing jig 60A, and a plurality of pins 66 are provided in the circumferential direction. A plurality of pin-inserting holes 37 are also provided at the upper surface of the connector main unit 30A so that the securing jig 60A can be attached thereto by inserting the pins 66 at predetermined positions.

The thus-configured connector 10A can prevent the curving direction of the tip of the dip tube 12A from being changed due to drag rotation because the joining portion 20 is screwed in independently of the connector main unit 30A when attaching the connector by using the securing jig 60A that, by being attached from the upper surface of the connector main unit 30A, causes the depressed/protruding portions of the pins 66 and the pin-inserting holes 37 to be engaged, thus preventing relative rotation to each other, and by using the tightening jig 70 that tightens the male threaded portion 22 by being engaged at the upper surface of the joining portion 20.

In other words, when attaching the connector, the joining portion 20 can be tightened by the tightening jig 70 while holding the connector main unit 30A by using the securing jig 60A so that the connector main unit 30A and the dip tube 12A are not rotated, and, consequently, it is possible to maintain the curving direction of the tip of the dip tube 12A inserted into the container 50, which is oriented in the desired direction in advance so as not to overlap with the upper surface of the protruding portion of the parting line PL.

With regard to the depressed/protruding portions of the pins 66 and the pin-inserting holes 37, the protruding portions may be provided at the upper surface of the connector main unit 30A so as to be inserted into the depressed portions in the securing jig.

As described above, with the liquid-tank connector of this embodiment described above, a curved liquid draw-out tube (siphon tube 12 or dip tube 12A), which is oriented in a desired direction in the container 50, can be prevented from being rotated together with the connector main unit 30 due to tightening of the joining portion when attaching the connector. As a result, the position (direction) of the tip of the curved liquid draw-out tube does not change due to tightening of the joining portion for attaching the connector; therefore, even in the case in which the connector is used by being attached to a blow-molded container 50, the amount of liquid remaining in the container 50 can reliably be reduced because the liquid draw-out tube can be easily and reliably installed at a position where the curved tip that takes in liquid is away from the parting line PL.

The present invention is not limited to the above-described embodiment, and appropriate alterations are possible within a range that does not depart from the spirit thereof.

REFERENCE SIGNS LIST

10, 10A liquid-tank connector (connector)
12 siphon tube (liquid draw-out tube)
12A dip tube (liquid draw-out tube)
20 joining portion
22 male threaded portion (outer threaded portion)
24 joining-portion projection
26 jig-attaching hole
30, 30A connector main unit (main unit)
32 plug portion
34 flange portion
37 pin-inserting hole (depressed portion)
38 main-unit projection
39 protruding portion (depressed/protruding portion)
40 cap
50 container
52A, 52B opening (vent plug portion)
56 socket
58 inner lid
58*a* female threaded portion (inner threaded portion)
60, 60A securing jig
61 handle
62 locking portion
63 depressed portion (depressed/protruding portion)
66 pin (protruding portion)
70 tightening jig

71 jig main unit
72 through-hole
73 projected portion
74 tool hole
Kr key ring
Ma curving-direction indicating portion
Mb, Mb' insertion-position indicating portion
CL center axis
BL dividing line
PL parting line

The invention claimed is:

1. A liquid-tank connector that is installed at a vent plug portion of a container storing liquid and that draws out the liquid from the container, the liquid-tank connector comprising:

a joining portion in which an outer threaded portion that is threaded to a container-side inner threaded portion formed in the vent plug portion is formed;

a main unit that is disposed at an inner side of the joining portion, sharing a center axis therewith, and that is connected so as to be rotatable relative thereto;

a liquid draw-out tube that is attached to the main unit so as to extend toward a bottom portion of the container and that has a tip curved in a substantially horizontal direction, wherein the joining portion is screwed in independently of the main unit when attaching the connector by using a securing jig that, by being attached from above to the main unit, causes depressed/protruding portions provided between contact surfaces to be engaged, thus preventing relative rotation to each other, and by using a tightening jig that tightens the outer threaded portion by being engaged at an upper surface of the joining portion;

wherein the securing jig is inserted from above into a circular hollow portion formed at the upper surface of the main unit, thus engaging the depressed/protruding portions between the contact surfaces; and wherein the circular hollow portion is a key ring portion that is attached at a top portion of the main unit, forming a single piece therewith.

2. The liquid-tank connector according to claim 1, wherein the depressed/protruding portions between the contact surfaces are a depressed portion or protruding portion provided at an outer circumferential surface of the securing jig and a protruding portion or depressed portion formed at an inner circumferential surface of the circular hollow portion.

3. The liquid-tank connector according to claim 2, wherein the protruding portion or depressed portion is provided at the circular hollow portion in different combinations in terms of the numbers thereof arranged in a circumferential direction depending on a type of the connector.

4. The liquid-tank connector according to claim 3, wherein the protruding portion or depressed portion provided at the outer circumferential surface of the securing jig is provided so as to be compatible with multiple types of connector with respect to the protruding portion or depressed portion at the circular hollow portion.

5. The liquid-tank connector according to claim 1, wherein the main unit is provided with a curving-direction indicating portion for the liquid draw-out tube at the upper surface of the outer circumference.

6. The liquid-tank connector according to claim 5, wherein the securing jig is provided with an insertion-position indicating portion whose position in a circumferential direction is aligned with the curving-direction indicating portion at a position where the depressed/protruding portions are engaged.

* * * * *